US008752828B2

(12) United States Patent
Nakamura et al.

(10) Patent No.: US 8,752,828 B2
(45) Date of Patent: Jun. 17, 2014

(54) IMAGE FORMING APPARATUS AND SHEET SIZE DETECTION METHOD

(75) Inventors: Satoru Nakamura, Osaka (JP); Masaaki Maruta, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 13/436,272

(22) Filed: Mar. 30, 2012

(65) Prior Publication Data

US 2012/0248677 A1 Oct. 4, 2012

(30) Foreign Application Priority Data

Mar. 30, 2011 (JP) ..... 2011-074191

(51) Int. Cl.
*B65H 9/04* (2006.01)
*B65H 7/02* (2006.01)

(52) U.S. Cl.
USPC ..... 271/242; 271/265.02; 271/265.01; 271/266

(58) Field of Classification Search
USPC ..... 271/242, 265.01, 266, 265.02
See application file for complete search history.

(56) References Cited

U.S. PATENT DOCUMENTS

| | | | | |
|---|---|---|---|---|
| 3,863,913 | A * | 2/1975 | Hirafuji | 271/265.02 |
| 5,543,909 | A * | 8/1996 | Quesnel | 399/394 |
| 5,738,349 | A * | 4/1998 | Shirasaki | 271/242 |
| 5,933,697 | A * | 8/1999 | Onodera et al. | 399/406 |
| 6,173,952 | B1 * | 1/2001 | Richards et al. | 271/228 |
| 6,738,596 | B2 * | 5/2004 | Kamimura et al. | 399/396 |
| 7,957,687 | B2 * | 6/2011 | Ito | 399/389 |
| 2009/0278304 | A1 * | 11/2009 | Hara et al. | 271/225 |
| 2010/0226667 | A1 | 9/2010 | Ogihara et al. | |
| 2012/0027426 | A1 * | 2/2012 | Maruta | 399/16 |

FOREIGN PATENT DOCUMENTS

| | | | |
|---|---|---|---|
| JP | 08-272165 | A | 10/1996 |
| JP | 09-156802 | A | 6/1997 |
| JP | 09-175692 | A | 7/1997 |
| JP | 2004-182370 | A | 7/2004 |
| JP | 2008-013338 | A | 1/2008 |
| JP | 2009-300838 | A | 12/2009 |
| JP | 2010-210664 | A | 9/2010 |

OTHER PUBLICATIONS

Translation and English Abstract for JP 09-175692 A, published Jul. 8, 1997.

(Continued)

*Primary Examiner* — Luis A Gonzalez
(74) *Attorney, Agent, or Firm* — NDQ&M Watchstone LLP

(57) ABSTRACT

An image forming apparatus includes an image forming unit, a sheet feeding unit for feeding a sheet, a registration roller for transporting the sheet toward the image forming unit, a rotational member for transporting the sheet toward the registration roller, at least one detection member provided on an upstream side of the registration roller, and a sheet size detection unit configured to receive an output from the detection member. The rotational member is configured to continue rotation until transportation of the sheet is completed. The registration roller is configured to rotate when a predetermined waiting time period has elapsed since the detection member detects sheet arrival. The sheet size detection unit is configured to detect a size of the sheet using a time period from a time when the detection member detects the sheet arrival to a time when the detection member detects sheet passage.

12 Claims, 10 Drawing Sheets

(56) References Cited

OTHER PUBLICATIONS

Translation and English Abstract for JP 09-156802 A, published Jun. 17, 1997.
Translation and English Abstract for JP 2004-182370 A, published Jul. 2, 2004.
Translation and English Abstract for JP 2009-300838 A, published Dec. 24, 2009.
Translation and English Abstract for JP 2008-013338 A, published Jan. 24, 2008.

* cited by examiner

FIG.7

| SHEET TRANSPORTATION SPEED | x[mm/sec] |
|---|---|
| WAITING TIME PERIOD | y[sec] |
| MEASURED TIME PERIOD(SEC.) | SHEET SIZE |
| t1～t2 | A4 LONG SIDE OR A3 SHORT SIDE |
| t3～t4 | A5 LONG SIDE OR A4 SHORT SIDE |
| t5～t6 | A6 LONG SIDE OR A5 SHORT SIDE |
| ⋮ | ⋮ |
| t7～t8 | LETTER SIZE |

FIG.8

| No. | CORRECTION MEASUREMENT TIME PERIOD (SEC.) | DEVIATION FROM REFERENCE MEASUREMENT TIME PERIOD (SEC.) |
|---|---|---|
| 1 | A1 | D1 |
| 2 | A2 | D2 |
| 3 | A3 | D3 |
| ⋮ | ⋮ | ⋮ |
| 500 | A500 | D500 |

IMAGE FORMING APPARATUS AND SHEET SIZE DETECTION METHOD

This application is based upon and claims the benefit of priority from the corresponding Japanese Patent Application No. 2011-074191 filed on Mar. 30, 2011, the entire contents of which are incorporated herein by reference.

BACKGROUND OF THE DISCLOSURE

1. Field of the Disclosure

The present disclosure relates to an image forming apparatus, such as a printer, a multifunction peripheral, a copying machine, and a facsimile machine, including registration rollers for sending out a sheet after bending the sheet.

2. Description of Related Art

In an image forming apparatus, a sheet is transported and an image is formed on the sheet that is being transported. Further, there is an image forming apparatus, in which a sheet size is detected using a sensor for detecting the transported sheet. Such an image forming apparatus confirms whether or not the detected sheet size is different from a sheet size set by a user. For example, when the detected sheet size is different from the sheet size set by the user, the image forming apparatus detects that an error or a jam has occurred. The following image forming apparatus is known as an example.

There is known such a copying apparatus having at least one of a duplex copying function, a mutilayer copying function, and a reverse delivery function, and including detection means for detecting a sheet size during transportation of the sheet, determination means for determining whether or not the sheet size detected by the detection means is the same as a preset sheet size when any one of the duplex copying function, the mutilayer copying function, and the reverse delivery function is selected, control means for performing, when it is determined that the sheet size detected by the detection means is not the same as the preset sheet size, simplex copying on the sheet without executing the selected any one of the functions, and delivering the sheet outside the apparatus, and notification means for notifying, when it is determined that the sheet size detected by the detection means is not the same as the preset sheet size, that the sheet size detected by the detection means is not the same as the preset sheet size. With this configuration, it may be possible to prevent a jam caused by the transportation of the sheet having a size different from the set sheet size.

The image forming apparatus may include a registration roller pair (registration rollers) for temporarily stopping the sheet. In this case, the registration roller pair is provided on an upstream side of an image forming unit, which forms an image on the sheet, in a sheet transportation direction. The registration roller pair is used for correcting skew feed of the sheet. Specifically, a leading edge of the sheet is brought into abutment against the registration roller pair that is held in a stopped state. The sheet transportation is continued on a trailing edge side of the sheet, and accordingly the sheet is bent. Due to elasticity of the bent sheet, the leading edge of the sheet is aligned with a nip of the registration roller pair. Accordingly, the skew feed of the sheet is corrected.

Further, as in the case of the above-mentioned copying apparatus, the sheet size detection may be performed using a sensor for detecting the sheet, which is provided in the vicinity of the registration roller pair. For example, the sheet size detection may be performed based on a time period from the time when the registration roller pair is driven (rotated) to the time when the sensor detects passage of the sheet.

However, due to a slip of the sheet or the like, fluctuation occurs in the time period from the time when the registration roller pair is driven (rotated) to the time when the sensor detects the passage of the sheet. This fluctuation in time period detected by the sensor may be caused by fluctuation in bending amount of the sheet (degree of sheet bending) at the registration roller pair.

Conventionally, the sheet is bent at the registration roller pair by stopping the registration roller pair and also continuing the transportation on the trailing edge side of the sheet by rollers (for convenience, referred to as "intermediate rollers") for performing transportation one stage upstream of the registration roller pair. After the sheet is bent, in order to prevent excessive bending of the sheet, conventionally, the intermediate rollers are temporarily stopped until the registration roller pair rotates. After the intermediate rollers are stopped, the registration roller pair and the intermediate rollers rotate to send out the sheet toward the image forming unit.

In this manner, conventionally, the drive of the intermediate rollers is turned ON and OFF when the sheet is bent. However, fluctuation occurs in response speed of the intermediate rollers. For example, there occur an individual difference in response speed of a drive ON/OFF clutch, and decrease in response speed caused by deterioration over time. Therefore, the bending amount of the sheet is not easily kept constant. In particular, in recent years, there has been a demand for higher image formation speed, and therefore increase in rotation speed of the intermediate rollers (sheet transportation speed) has been promoted. As a result, the fluctuation in ON/OFF of the drive of the intermediate rollers greatly affects the fluctuation (error) in bending amount of the sheet. The fluctuation in bending amount of the sheet increases, and accordingly the fluctuation in time period detected by the sensor increases for the same sheet size. As a result, there arises a problem of difficulty in accurate sheet size detection. The sheet size may be detected erroneously as in a case where an A4 sheet is detected as a letter size sheet.

Further, conventionally, the sheet size detection may be performed by measuring the time period from the time when the registration roller pair is driven (rotated) to the time when the sensor detects the passage of the sheet. The drive of the registration roller pair is also turned ON and OFF, but an individual difference in response speed of a drive ON/OFF clutch of the registration roller pair, and decrease in response speed caused by deterioration over time may also be factors inhibiting the accurate sheet size detection.

Note that, as described above, the above-mentioned copying apparatus performs the sheet size detection based on the time period from the time when the registration roller pair is rotated to the time when the sensor detects the passage of the sheet. However, it is necessary to take some measures for avoiding the inaccurate sheet size detection.

SUMMARY OF THE DISCLOSURE

The present disclosure has been made in view of the above-mentioned problems inherent in the conventional technologies, and the present disclosure performs accurately sheet size detection by keeping a constant bending amount of a sheet brought into abutment against a registration roller.

In order to solve the above-mentioned problems, an image forming apparatus according to a exemplary embodiment of the present disclosure includes an image forming unit, a sheet feeding unit, at least one detection member, a registration roller, a rotational member, and a sheet size detection unit. The image forming unit forms an image on a sheet. The sheet feeding unit feeds the sheet. The at least one detection member is provided on an upstream side of the image forming unit in a sheet transportation direction. The registration roller transports the sheet fed from the sheet feeding unit toward the image forming unit, and the registration roller is configured to be held in a stopped state when the at least one detection member provided on the upstream side in the sheet transportation direction detects sheet arrival, and to rotate when a predetermined waiting time period has elapsed since the at least one detection member provided on the upstream side detects the sheet arrival. The rotational member transports the sheet fed from the sheet feeding unit toward the registration roller, and the rotational member is configured to continue rotation until transportation of all the sheets to be used for printing is completed. The sheet size detection unit detects a size of the sheet in response to an output from the at least one detection member using a time period from a time when the at least one detection member detects the sheet arrival to a time when the at least one detection member detects sheet passage.

According to the present disclosure, the rotational member is not stopped, and also the bending amount of the sheet brought into abutment against the registration roller is kept constant and the state of the sheet (degree of bending) at a time point when the registration roller starts transportation is kept constant at any time. Accordingly, the sheet transportation is performed in the same manner for any sheet. Thus, the fluctuation and error in time period measured for the sheet size detection can be reduced, with the result that the sheet size detection can be performed accurately.

Further features and advantages of the present disclosure will become apparent from the description of embodiments given below.

BRIEF DESCRIPTION OF THE DRAWINGS

FIG. 7 is an explanatory table showing an example of sheet size detection data.

FIG. 8 is a table showing an example of measurement result data on a time period from sheet arrival detection of the upstream sensor to sheet arrival detection of the downstream sensor (correction measurement time period).

DETAILED DESCRIPTION OF PREFERRED EMBODIMENTS

Hereinafter, a first embodiment of the present disclosure is described with reference to FIGS. 1 to 8, and a second embodiment of the present disclosure is described with reference to FIGS. 9 to 11. Note that, elements such as components and arrangements described in the embodiments are not limitations to the scope of the disclosure but merely examples for description thereof.

(Overview of Image Forming Apparatus)

Figure 1:
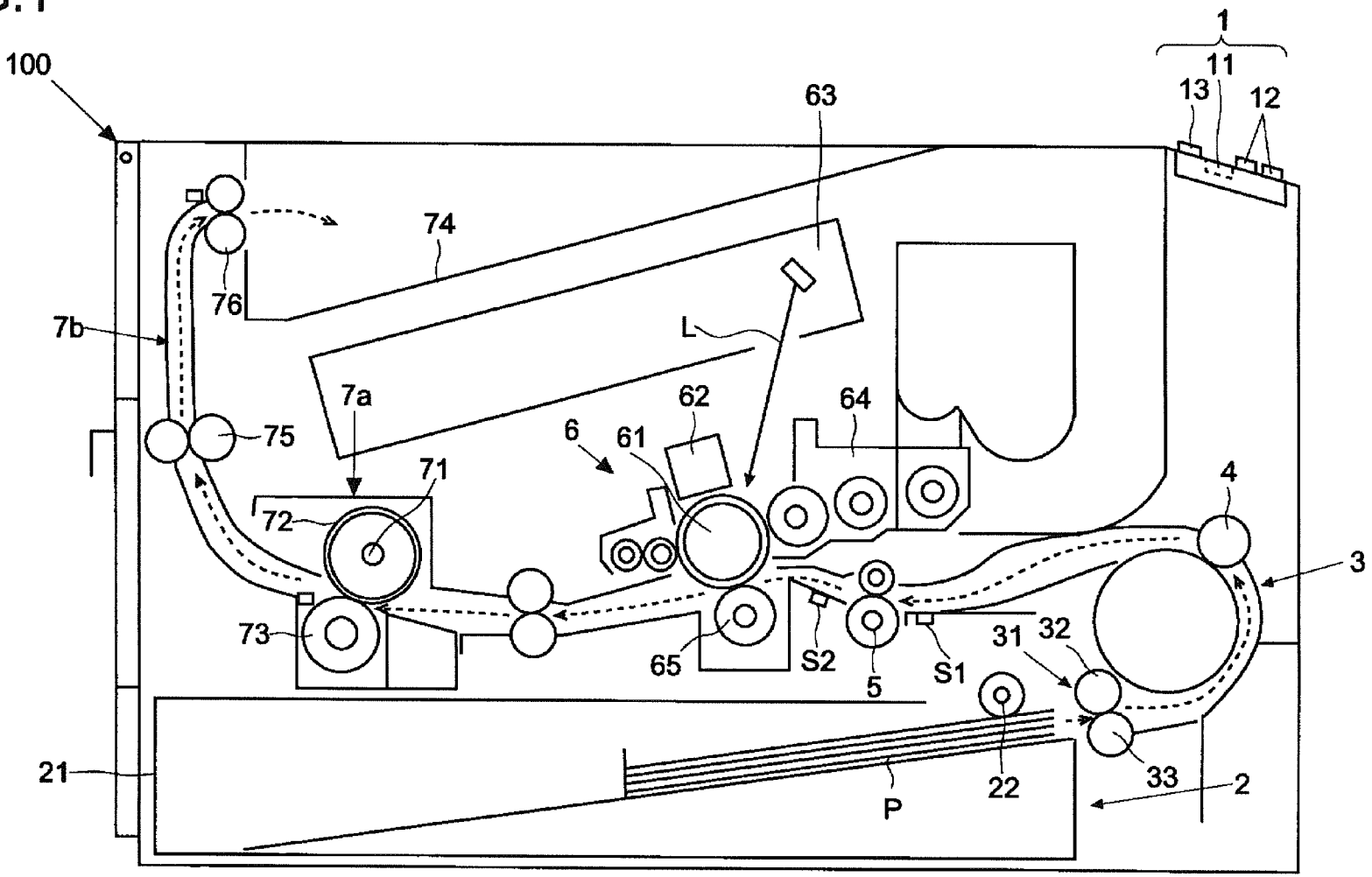
FIG. 1 is a schematic sectional left side view illustrating a schematic structure of a printer.

First, the first embodiment is described. Note that, in the following description, an electrophotographic digital printer 100 is taken as an example of the image forming apparatus. FIG. 1 is a schematic sectional left side view illustrating a schematic structure of the printer 100.

As illustrated in FIG. 1, an operation panel 1 (corresponding to an input unit) is provided on an upper portion of a front surface of the printer 100. Further, the operation panel 1 includes a liquid crystal display unit 11 (corresponding to a notification unit) for displaying a state of the printer 100 and various messages. The operation panel 1 also includes keys 12 for setting various functions of the printer 100 (for example, setting a size of a sheet P to be used for printing), and an indicator 13 (corresponding to the notification unit) that is turned ON and OFF along with the state of the printer 100 (state in which a job is in progress and state in which an error has occurred).

Further, as illustrated in FIG. 1, a sheet feeding unit 2 is arranged on a lower portion inside a main body of the printer 100. The sheet feeding unit 2 includes an insertable and removable cassette 21. A plurality of sheets P can be stacked on the cassette 21. Further, a sheet feeding roller 22 is provided in the sheet feeding unit 2. The sheet feeding roller 22 is brought into contact with an uppermost sheet P of the stacked sheets P, and is rotationally driven by a driving device (not shown) such as a motor. Through the drive of the sheet feeding roller 22, the sheet P is sent out from the cassette 21 for use in the printing.

A transportation unit 3 is connected to the sheet feeding unit 2 on its downstream side in a sheet transportation direction. In the transportation unit 3, the sheet P fed from the sheet feeding unit 2 is transported toward an image forming unit 6. The transportation unit 3 includes a handling unit 31, an intermediate roller pair 4 (corresponding to a rotational member), and a registration roller pair 5 (corresponding to a registration roller), which are arranged in an order from an upstream side of the transportation unit 3. Two or more stacked sheets P may be sent out from the sheet feeding unit 2 (multi-feed), and the handling unit 31 prevents the multi-feed of the sheets. The handling unit 31 includes a pair of rollers. An upper roller 32 arranged on an upper side of the handling unit 31 is rotationally driven in a direction in which the sheet P is sent toward the image forming unit 6, and a lower roller 33 arranged on a lower side of the handling unit 31 rotates in a direction in which the sheet P is sent back to the sheet feeding unit 2. The lower roller 33 sends the multi-fed sheets P back to the sheet feeding unit 2, to thereby eliminate the multi-feed of the sheet P.

The intermediate roller pair 4 transports the sheet P toward the registration roller pair 5 and the image forming unit 6. The registration roller pair 5 corrects skew feed of the sheet P (described later in detail). The registration roller pair 5 sends out the sheet P to the image forming unit 6 at a timing adjusted to a timing of a toner image formed by the image forming unit 6.

Note that, in the printer 100 of this embodiment, an upstream sensor S1 (corresponding to a detection member and an upstream detection member) for detecting arrival and passage of the sheet P is provided on a downstream side of the intermediate roller pair 4 and an upstream side of the registration roller pair 5 as well as in the vicinity thereof. Further, a downstream sensor S2 (corresponding to the detection member and a downstream detection member) for detecting arrival and passage of the sheet P is provided on a downstream side of the registration roller pair 5 and an upstream side of the image forming unit 6 (photosensitive drum 61 and transfer roller 65).

For example, the upstream sensor S1 is used for detecting the arrival of the sheet P at the vicinity of the registration roller pair 5, and adjusting a timing to start rotation of the registration roller pair 5. On the other hand, the downstream sensor S2 is used for detecting the approach of the sheet P to the image forming unit 6 (nip between the photosensitive drum 61 and the transfer roller 65), and adjusting a timing to start forming a toner image.

Toner image formation to be performed by the image forming unit 6 is described. The image forming unit 6 includes the photosensitive drum 61 for bearing a toner image while rotating at a predetermined speed. A charging unit 62 charges the photosensitive drum 61 at a constant potential. An exposure unit 63 provided on an upper portion of the image forming unit 6 irradiates the photosensitive drum 61 with a laser beam L based on image data and setting data for printing, which are transmitted from, for example, a computer 200 (see FIG. 2) to the printer 100. Accordingly, an electrostatic latent image is formed on the photosensitive drum 61. A developing device 64 supplies toner to the electrostatic latent image. Accordingly, a toner image is developed. The transfer roller 65 is held in press contact with the photosensitive drum 61. When the toner image and the sheet P enter the nip between the transfer roller 65 and the photosensitive drum 61, a transfer voltage is applied to the transfer roller 65. Accordingly, the toner image is transferred to the sheet P.

A fixing unit 7*a* for heating and pressurizing the sheet P having the toner image transferred thereto is provided on a downstream side of the image forming unit 6 in the sheet transportation direction. The fixing unit 7*a* includes a heat roller 72 incorporating a heating element 71, and a pressure roller 73 held in press contact with the heat roller 72 to form a nip therebetween. The sheet P bearing the unfixed toner image is sent to the fixing unit 7*a*, and the sheet P enters the nip. Accordingly, the toner is fused through the heating and pressurization so that the toner is fixed to the sheet P. The sheet P that has undergone the fixing is sent upward through a delivery transportation unit 7*b* (corresponding to a delivery unit), and is delivered to a delivery tray 74 provided on an uppermost portion of the main body. Note that, the delivery transportation unit 7*b* includes a transportation roller pair 75 and a delivery roller pair 76, which are rotationally driven to transportation the sheet P toward the delivery tray 74.

(Hardware Configuration of Printer 100)

Figure 2:
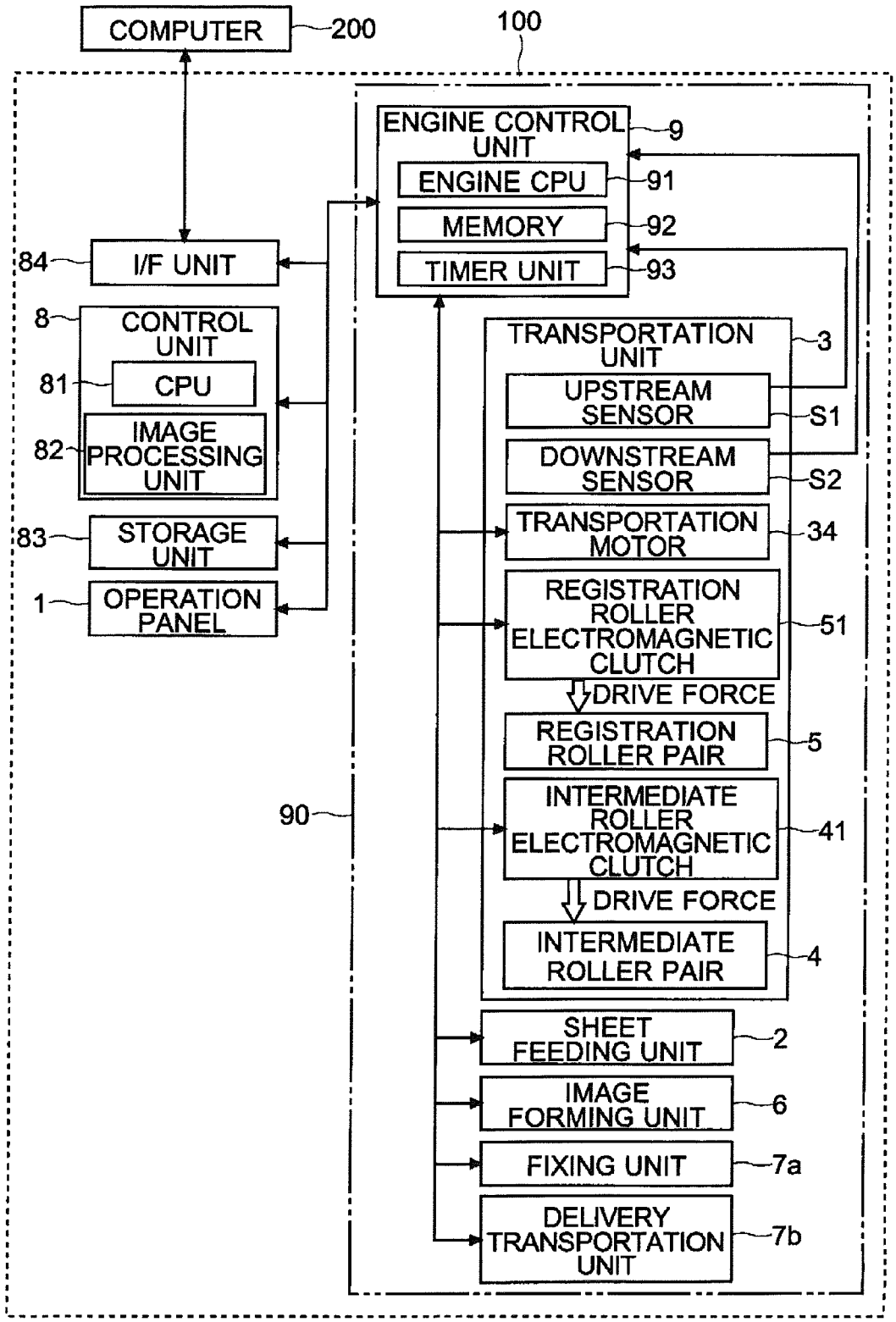
FIG. 2 is a block diagram illustrating an example of a hardware configuration of the printer.

Next, referring to FIG. 2, a hardware configuration of the printer 100 according to the first embodiment is described. FIG. 2 is a block diagram illustrating an example of the hardware configuration of the printer 100.

As illustrated in FIG. 2, the printer 100 includes a control unit 8 inside. The control unit 8 performs overall control, communication control, and image processing, to thereby control the respective components of the printer 100. For example, the control unit 8 is a circuit board including a CPU 81 and an image processing unit 82.

The control unit 8 is connected to a storage unit 83. The storage unit 83 is a combination of nonvolatile and volatile storage devices such as a ROM, a RAM, a flash ROM, and an HDD. For example, the storage unit 83 stores a control program and control data of the printer 100. Further, the CPU 81 is a central processing unit, and performs computation and control on the respective components of the printer 100 based on the control program and the setting data stored in the storage unit 83.

The image processing unit 82 is a circuit including an ASIC and an image processing RAM. The image processing unit 82 performs various kinds of image processing, such as enlargement, reduction, density conversion, and data format conversion, on the image data in accordance with the settings. Further, the image processing unit 82 sends image data after the image processing to the exposure unit 63. The exposure unit 63 performs scanning and exposure in response to the image data, to thereby form an electrostatic latent image on the photosensitive drum 61.

Further, the control unit 8 is connected to the operation panel 1. The control unit 8 recognizes an input performed through the operation panel 1. Further, the control unit 8 recognizes contents input using the keys 12. Further, the control unit 8 controls display and indication to be performed by the liquid crystal display unit 11 and the indicator 13 on the operation panel 1. For example, when an error such as a jam has occurred, the control unit 8 turns ON the indicator 13 to indicate that the error has occurred.

Further, the control unit 8 is connected to an I/F unit 84 (corresponding to the input unit). The I/F unit 84 is a communication interface for performing communications via a network and a cable to, for example, the computer 200 (for example, personal computer or server) serving as a transmission source of printing data including the image data for printing and the setting data for printing. The printer 100 performs printing based on the image data and the setting data for printing, which are input from the computer 200 to the I/F unit 84. The data to be received by the I/F unit 84 also includes data for designating a size of the sheet to be used for the printing. The I/F unit 84 receives an input for designating the size of the sheet to be used for the printing.

An engine control unit 9 (corresponding to a sheet size detection unit and a drive control unit) is provided inside the apparatus so as to control the part of the printer 100 which is involved in the image formation (engine unit 90, for example, the sheet feeding unit 2, the transportation unit 3, the image forming unit 6, the fixing unit 7*a*, and the delivery transportation unit 7*b*). The engine control unit 9 is a circuit board including an engine CPU 91, a memory 92, and a timer unit 93. The engine CPU 91 is a processer for performing computation and processing based on a program and data stored in the memory 92. The memory 92 is a ROM and a RAM for storing a control program and control data on the image formation. The timer unit 93 counts time on the control. Note that, the engine CPU 91 may count time.

The engine control unit 9 controls operations of the respective components of the engine unit 90 so that the image formation is appropriately performed based on the control program and the control data on the printing, which are stored in the memory 92. Note that, this embodiment is directed to an example in which the engine control unit 9 configured specifically for controlling the part of the printer 100 which is involved in the image formation (engine unit 90) is provided separately from the control unit 8. Alternatively, the engine control unit 9 and the control unit 8 may be integrated so that the control unit 8 has a function of and performs the processing of the engine control unit 9.

The engine control unit 9 controls the printing. Specifically, the engine control unit 9 turns ON and OFF the motors for rotating various rotational members of the sheet feeding unit 2, the transportation unit 3, the image forming unit 6, the fixing unit 7*a*, and the delivery transportation unit 7*b*, to thereby control the sheet feeding, the sheet transportation, the toner image formation in the image forming unit 6, and the fixing temperature in the fixing unit 7*a*.

As illustrated in FIG. 2, for the sheet transportation, for example, the transportation unit 3 includes, for example, a transportation motor 34, a registration roller electromagnetic clutch 51, and an intermediate roller electromagnetic clutch 41 as well as the above-mentioned upstream sensor S1 and downstream sensor S2.

Each of the upstream sensor S1 and the downstream sensor S2 is, for example, an optical sensor. As the optical sensor, there may be used a reflective optical sensor including a light emitting portion for emitting light toward the transportation unit 3, and a light receiving portion for receiving the light reflected on the sheet P. Further, as the optical sensor, there may be used a transmissive optical sensor including a light emitting portion, a light receiving portion, and an actuator movable in contact with the transported sheet P. For example, when the sheet P has not arrived at the transmissive optical sensor or is not passing therethrough, the actuator blocks the light from the light emitting portion toward the light receiving portion, and when the sheet P has arrived at the transmissive optical sensor or is passing therethrough, the actuator is shifted in position and the light from the light emitting portion arrives at the light receiving portion, with the result that the output from the transmissive optical sensor changes. Note that, other type of sensor than the optical sensor may be used as long as the sensor can detect the arrival and passage of the sheet P.

In this manner, the outputs (output voltage values) from the upstream sensor S1 and the downstream sensor S2 are switched in accordance with the situation in which the presence of the sheet P is detected and the situation in which the presence of the sheet P is not detected. The outputs from the upstream sensor S1 and the downstream sensor S2 are input to the engine control unit 9. Based on the outputs from the upstream sensor S1 and the downstream sensor S2 (for example, High or Low and switching from High to Low or from Low to High), the engine control unit 9 can recognize whether or not the sheet P has arrived at the installation positions of the respective sensors and whether or not the sheet P thus arrived has passed therethrough.

The transportation motor 34 is a drive source for rotating the registration roller pair 5 and the intermediate roller pair 4. The engine control unit 9 rotates the transportation motor 34 so that the registration roller pair 5 and the intermediate roller pair 4 rotate at a predetermined speed. The registration roller electromagnetic clutch 51 is used for turning ON and OFF transmission of a drive force from the transportation motor 34 to the registration roller pair 5, to thereby control the rotation of the registration roller pair 5. When the registration roller pair 5 is rotated, the engine control unit 9 rotates the transportation motor 34 and also brings the registration roller electromagnetic clutch 51 into an ON state (coupled state). Accordingly, the registration roller pair 5 rotates. On the other hand, when the registration roller pair 5 is stopped, the engine control unit 9 stops the transportation motor 34 or brings the registration roller electromagnetic clutch 51 into an OFF state (released state). Accordingly, the registration roller pair 5 is held in the stopped state.

The intermediate roller electromagnetic clutch 41 is used for turning ON and OFF transmission of a drive force from the transportation motor 34 to the intermediate roller pair 4, to thereby control the rotation of the intermediate roller pair 4. When the intermediate roller pair 4 is rotated, the engine control unit 9 rotates the transportation motor 34 and also brings the intermediate roller electromagnetic clutch 41 into an ON state (coupled state). Accordingly, the intermediate roller pair 4 rotates. On the other hand, when the intermediate roller pair 4 is stopped, the engine control unit 9 stops the transportation motor 34 or brings the intermediate roller electromagnetic clutch 41 into an OFF state (released state). Accordingly, the intermediate roller pair 4 is stopped.

(Bending of Sheet P)

Figure 3:
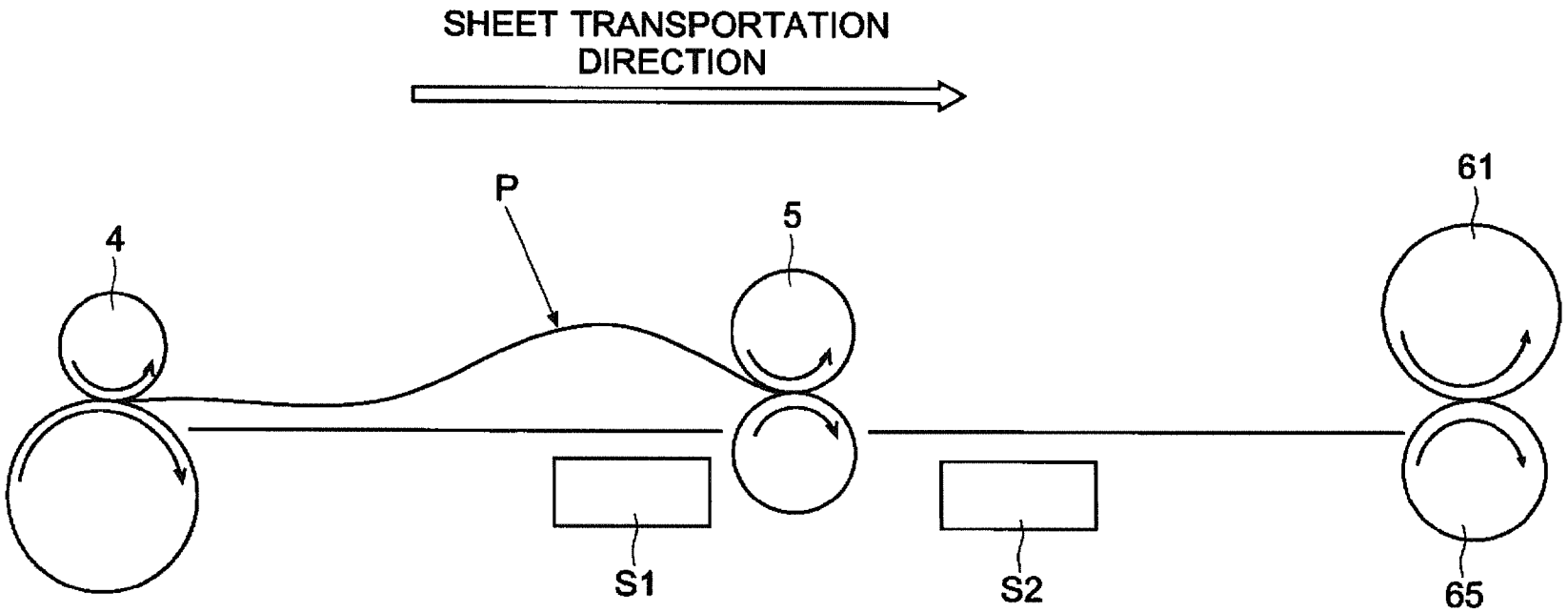
FIG. 3 is an explanatory view illustrating sheet bending to be performed in the printer.

Next, referring to FIG. 3, description is given of bending of the sheet P to be performed in the printer 100 according to the first embodiment. FIG. 3 is an explanatory view illustrating the bending of the sheet P to be performed in the printer 100.

Specifically, FIG. 3 is a schematic view illustrating, from the left, the intermediate roller pair 4, the upstream sensor S1, the registration roller pair 5, the downstream sensor S2, and the image forming unit 6 (photosensitive drum 61 and transfer roller 65), and illustrating a sheet transportation path from the intermediate roller pair 4 to the image forming unit 6. Further, for convenience, FIG. 3 illustrates the sheet transportation path on a straight line assuming that vertical positions of the intermediate roller pair 4, the registration roller pair 5, and the image forming unit 6 are substantially the same. Further, for convenience, in FIG. 3, it is assumed that a distance between the intermediate roller pair 4 and the registration roller pair 5 is substantially the same as a distance between the registration roller pair 5 and the image forming unit 6.

In the printer 100 of this embodiment, the engine control unit 9 brings the sheet P into abutment against the registration roller pair 5 and also causes the intermediate roller pair 4 to perform the sheet transportation, to thereby bend the sheet P. Therefore, referring to FIG. 3, description is given of the bending of the sheet P to be performed in the printer 100 of this embodiment.

The engine control unit 9 rotates the intermediate roller pair 4 to transport the sheet P fed from the sheet feeding unit 2 toward the registration roller pair 5. Then, based on the output from the upstream sensor S1, the engine control unit 9 recognizes that the leading edge of the sheet P having passed through the intermediate roller pair 4 is detected by the upstream sensor S1. In other words, based on the output from the upstream sensor S1, the engine control unit 9 recognizes that the sheet P has arrived at the upstream sensor S1.

When the sheet P has arrived at the upstream sensor S1, the engine control unit 9 holds the registration roller pair 5 in the stopped state. Then, the engine control unit 9 causes the intermediate roller pair 4 to continue the sheet transportation under the state in which the registration roller pair 5 is stopped. As a result, due to elasticity of the bent sheet P, the leading edge of the sheet P is brought into abutment against the registration roller pair 5 and the leading edge of the sheet P is aligned with the nip of the registration roller pair 5. Accordingly, even when the skew feed of the sheet P has occurred (even when the sheet P is transported on the skew), the skew feed is corrected.

In the printer 100 of this embodiment, the intermediate roller pair 4 continues to rotate irrespective of the detection of the arrival of the sheet P by the upstream sensor S1 and the stop and rotation of the registration roller pair 5. When a predetermined waiting time period W1 has elapsed since the arrival of the sheet P is detected by the upstream sensor S1, the engine control unit 9 rotates the registration roller pair 5. In this embodiment, even when the sheet P is bent and the registration roller pair 5 rotates to send out the sheet P, the intermediate roller pair 4 is not stopped until one printing job is completed. This configuration eliminates an error in bending amount of the sheet P among the individual printers 100 and an error in bending amount of the sheet P depending on a use period of the printer 100, which are caused by the intermediate roller pair 4 based on factors such as an individual difference in response speed of the intermediate roller electromagnetic clutch 41 and the fluctuation and decrease in response speed due to the deterioration of the intermediate roller electromagnetic clutch 41 over time. Further, the bending amount of the sheet P (degree of bending of the sheet P) is kept constant.

When the registration roller pair 5 rotates, based on the output from the downstream sensor S2, the engine control unit 9 recognizes that the leading edge of the sheet P sent out from the registration roller pair 5 is detected by the downstream sensor S2. In other words, based on the output from the downstream sensor S2, the engine control unit 9 recognizes that the sheet P has arrived at the downstream sensor S2. When the engine control unit 9 recognizes the sheet arrival at the downstream sensor S2, for example, the engine control unit 9 causes the image forming unit 6 to start the image formation. Accordingly, the toner image can be accurately transferred to a desired position in the sheet P.

(Sheet Size Detection)

Figure 4:
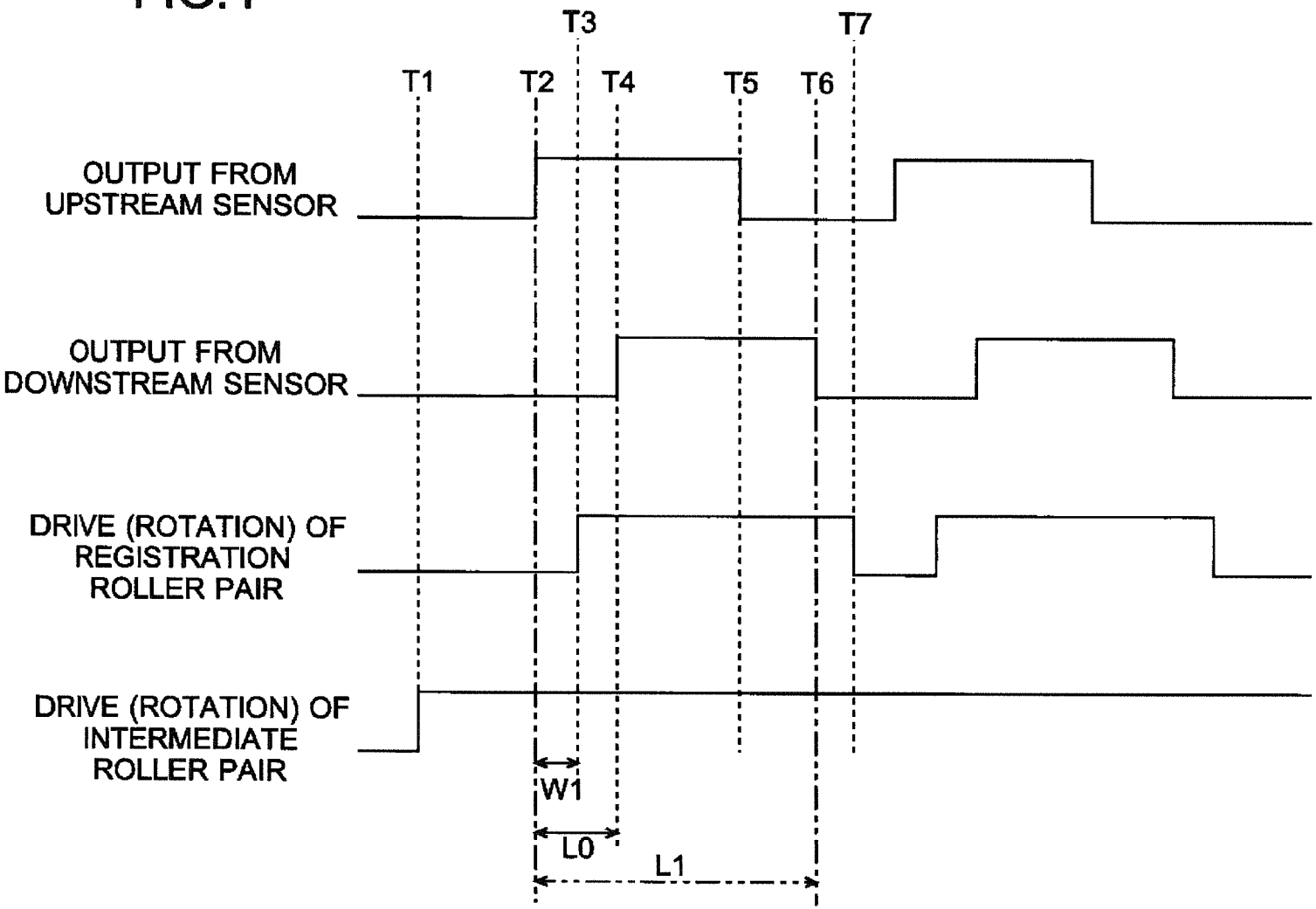
FIG. 4 is a timing chart illustrating sheet size detection to be performed in the printer according to a first embodiment of the present disclosure.

Next, referring to FIG. 4, description is given of an example of sheet size detection to be performed in the printer 100 according to the first embodiment. FIG. 4 is a timing chart illustrating the sheet size detection to be performed in the printer 100 according to the first embodiment.

First, a chart on the topmost stage in FIG. 4 illustrates changes in output from the upstream sensor S1. Further, a chart on the second top stage in FIG. 4 illustrates changes in output from the downstream sensor S2. Note that, in this embodiment, as illustrated in FIG. 4, the upstream sensor S1 and the downstream sensor S2 each output a High when the presence of the sheet P is detected, and output a Low when the presence of the sheet P is not detected. Note that, the positive-negative logic of the respective sensors may be reversed.

Further, a chart on the third top stage in FIG. 4 illustrates ON/OFF of the drive of the registration roller pair 5, in which a High indicates a rotating state of the registration roller pair 5 and a Low indicates a stopped state of the registration roller pair 5. In other words, the chart on the third top stage in FIG. 4 illustrates a signal from the engine control unit 9 for instructing the registration roller electromagnetic clutch 51 to start rotation of the registration roller pair 5 (signal for instructing coupling and releasing of the registration roller electromagnetic clutch 51), in which a High indicates a rotating state of the registration roller pair 5 and a Low indicates a stopped state of the registration roller pair 5.

Further, a chart on the bottommost stage in FIG. 4 illustrates ON/OFF of the drive of the intermediate roller pair 4, in which a High indicates a rotating state of the intermediate roller pair 4 and a Low indicates a stopped state of the intermediate roller pair 4. In other words, the chart on the bottommost stage in FIG. 4 illustrates a signal from the engine control unit 9 for instructing the intermediate roller electromagnetic clutch 41 to start rotation of the intermediate roller pair 4 (signal for instructing coupling and releasing of the intermediate roller electromagnetic clutch 41), in which a High indicates a rotating state of the intermediate roller pair 4 and a Low indicates a stopped state of the intermediate roller pair 4.

Next, the timing chart is described along with the elapse of time. First, the engine control unit 9 rotates the intermediate roller pair 4 so as to transport the sheet P (time point T1 in FIG. 4). The sheet P is transported by the intermediate roller pair 4, and as a result, the sheet P arrives at the upstream sensor S1. The engine control unit 9 recognizes a change in output from the upstream sensor S1, and recognizes the sheet arrival at the upstream sensor S1 (time point T2 in FIG. 4).

Then, the engine control unit 9 holds the registration roller pair 5 in the stopped state until the predetermined waiting time period W1 (period between T2 and T3 in FIG. 4) elapses since the sheet arrival at the upstream sensor S1. Accordingly, the sheet P is bent to the same degree at any time. When the waiting time period W1 has elapsed since the sheet arrival at the upstream sensor S1, the engine control unit 9 rotates the registration roller pair 5 (time point T3 in FIG. 4).

When the registration roller pair 5 starts to transport the sheet toward the image forming unit 6, the sheet P arrives at the downstream sensor S2. The engine control unit 9 recognizes a change in output from the downstream sensor S2, and recognizes the sheet arrival at the downstream sensor S2 (time point T4 in FIG. 4). After that, through the sheet transportation by the registration roller pair 5, the trailing edge of the sheet P passes through the upstream sensor S1, with the result that the output from the upstream sensor S1 falls. Accordingly, the engine control unit 9 recognizes a change in output from the upstream sensor S1, and recognizes that the sheet P has passed through the upstream sensor S1 (time point T5 in FIG. 4).

Further, the registration roller pair 5 transports the sheet P, and the sheet P is transported along with the rotation of the photosensitive drum 61 and the transfer roller 65. Accordingly, the trailing edge of the sheet P passes through the downstream sensor S2, with the result that the output from the downstream sensor S2 falls. Accordingly, the engine control unit 9 recognizes a change in output from the downstream sensor S2, and recognizes that the sheet P has passed through the downstream sensor S2 (time point T6 in FIG. 4). In order to hold the registration roller pair 5 in the stopped state when the succeeding sheet P arrives at the registration roller pair 5, the engine control unit 9 stops the registration roller pair 5 by the time when the upstream sensor S1 detects the arrival of the succeeding sheet P (time point T7 in FIG. 4). Note that, as illustrated in FIG. 4, in the printer 100 of this embodiment, the intermediate roller pair 4 continues to rotate until the transportation of all the sheets P is completed in the job (except such a special case that an error has occurred).

Next, specific description is given of the sheet size detection to be performed in the printer 100 of this embodiment. In the printer 100 of this embodiment, based on a time period from the time when the upstream sensor S1 detects the arrival of the sheet P to the time when the downstream sensor S2 detects the passage of the sheet P (first measurement time period L1, which is a time period from T2 to T6 in FIG. 4), the size of the sheet P in the sheet transportation direction is detected.

In the printer 100 of this embodiment, the bending amount of the sheet P (degree of bending) is substantially the same at any time. Therefore, the state of the sheet P to be sent out from the registration roller pair 5 is substantially the same among the sheets P. Thus, as long as the sheet size is the same, the time period from the sheet arrival detection of the upstream sensor S1 to the sheet passage detection of the downstream sensor S2 (first measurement time period L1) is substantially the same at any time.

Therefore, in the printer 100 of this embodiment, the engine control unit 9 detects the sheet size based on the above-mentioned first measurement time period L1. Therefore, description is given of a flow of the sheet size detection using the upstream sensor S1 and the downstream sensor S2.

(Flow of Sheet Size Detection)

Figure 5:
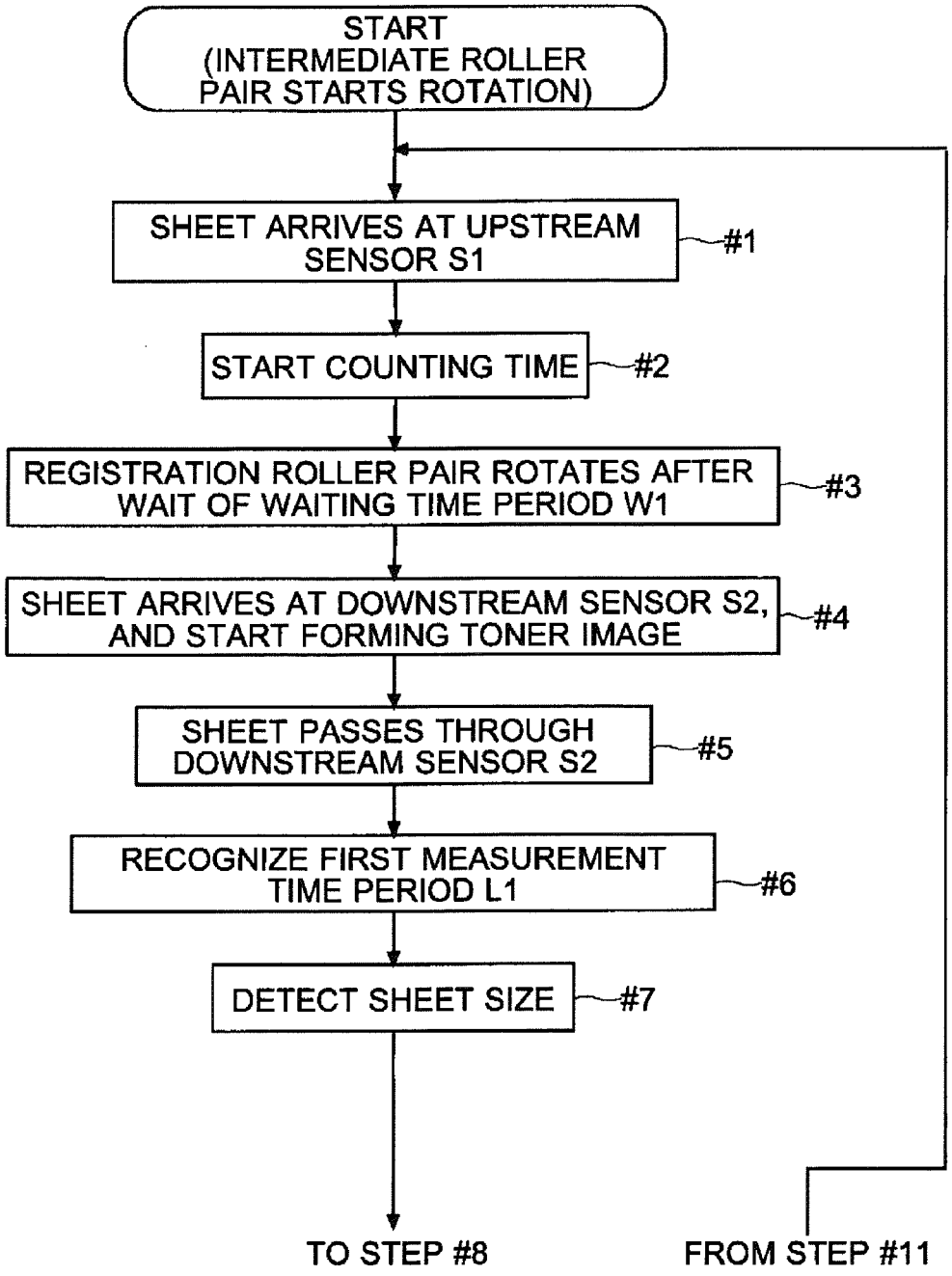
FIG. 5 is a flow chart illustrating an example of a flow of the sheet size detection to be performed in the printer using an upstream sensor and a downstream sensor according to the first embodiment.
Figure 6:
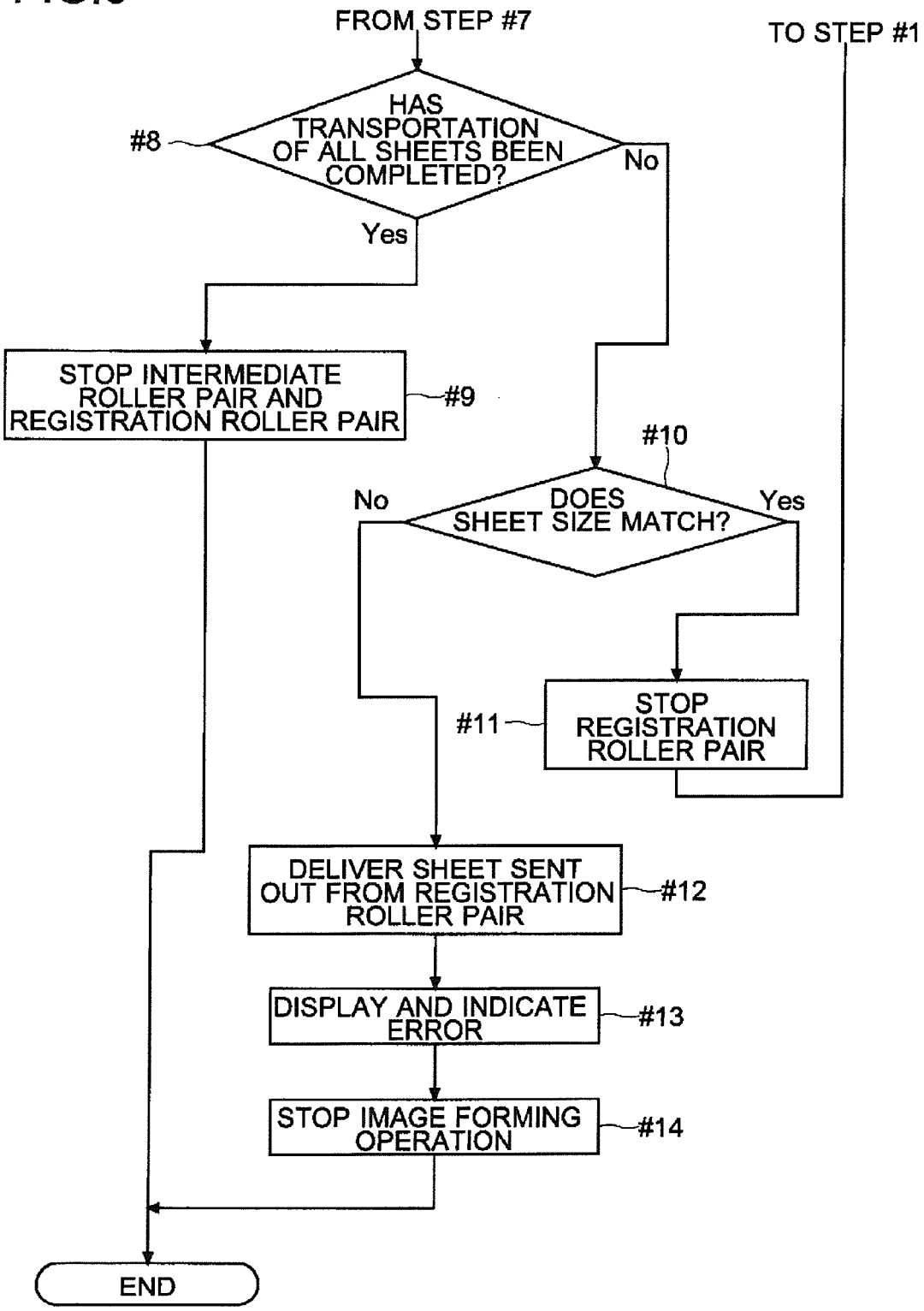
FIG. 6 is a flow chart illustrating the example of the flow of the sheet size detection to be performed in the printer using the upstream sensor and the downstream sensor according to the first embodiment.

Referring to FIGS. 5 to 7, description is given of the flow of the sheet size detection to be performed in the printer 100 using the upstream sensor S1 and the downstream sensor S2 according to the first embodiment. FIGS. 5 and 6 are flow charts illustrating an example of the flow of the sheet size detection to be performed in the printer 100 using the upstream sensor S1 and the downstream sensor S2 according to the first embodiment. Note that, the flow is long, and hence a sequential flow chart is divided into two in FIGS. 5 and 6. FIG. 7 is an explanatory table showing an example of sheet size detection data.

The flow chart starts at a time point when the I/F unit 84 receives the image data and the setting data for printing from the external computer 200 so that the printing is started, and therefore the sheet is fed and the engine control unit 9 causes the intermediate roller pair 4 to start rotation. For example, in the computer 200 that transmits the image data, printer driver software for using the printer 100 is installed. On the printer driver software, the size of the sheet P to be used for the printing can be set. The sheet size thus set is transmitted to the printer 100 (I/F unit 84) as the setting data for printing. Further, the size of the sheet to be used may be preset through the operation panel 1. Therefore, at the time point of the start of the flow chart, the engine control unit 9 grasps the sheet size that is desired (designated) by a user for use in the printing.

When the printing is started and therefore the intermediate roller pair 4 starts rotation (START), the engine control unit 9 recognizes the sheet arrival at the upstream sensor S1 (Step #1). The engine control unit 9 starts counting time (for example, the timer unit 93 counts time: Step #2). After the engine control unit 9 waits the predetermined waiting time period W1, the engine control unit 9 rotates the registration roller pair 5 (Step #3). Subsequently, the engine control unit 9 detects the sheet arrival at the downstream sensor S2, and starts forming the toner image (Step #4).

Subsequently, the engine control unit 9 detects that the sheet P has passed through the downstream sensor S2 (Step #5). Along with the detection, the engine control unit 9 recognizes the time period from the sheet arrival detection of the upstream sensor S1 to the sheet passage detection of the downstream sensor S2 (first measurement time period L1) (Step #6). Then, the engine control unit 9 detects the sheet size based on the first measurement time period L1 and the sheet size detection data (Step #7).

There are conceived various methods for determining the sheet size based on the measured time period. For example, the time period from the sheet arrival detection of the upstream sensor S1 to the sheet passage detection of the downstream sensor S2 (first measurement time period L1) includes the waiting time period W1, in which the registration roller pair 5 is held in the stopped state. In other words, when the predetermined waiting time period W1 is subtracted from the first measurement time period L1, a substantial time period required to transport a single sheet P between two points, that is, the upstream sensor S1 and the downstream sensor S2, is determined.

On the other hand, the sheet transportation speed is predetermined in terms of the specification and design of the printer 100. Therefore, the engine control unit 9 rotates the registration roller pair 5 at the sheet transportation speed thus determined. For example, the engine control unit 9 subtracts the waiting time period W1 from the first measurement time period L1, and determines a distance through multiplication by the predetermined sheet transportation speed. When the engine control unit 9 subtracts a predetermined (fixed) distance between the upstream sensor S1 and the downstream sensor S2 from the distance thus determined, the size of the sheet P in the sheet transportation direction can be determined. In this manner, the engine control unit 9 can detect the sheet size through computation. For example, in the memory 92 of the engine control unit 9, data indicating the sheet transportation speed and data indicating the waiting time period W1 of the registration roller pair 5 may be prestored as the sheet size detection data to be used for the computation (see FIG. 7).

Further, the engine control unit 9 compares the size of the sheet P thus determined to the standard sheet sizes of the sheet P, such as A-series sheets (A4, A3, and the like) and a letter size sheet, and determines a standard size that most closely matches with the size thus determined In this manner, the engine control unit 9 can also detect the corresponding standard size of the sheet P in use. For example, in the memory 92 of the engine control unit 9, data that defines the lengths of the sheet P of various standard sizes is stored as the sheet size detection data (the standard sheet size is predetermined in conformity to standards, and hence the illustration is omitted herein). The engine control unit 9 refers to the data stored in the memory 92, to thereby detect the size of the sheet P in use.

Further, in the printer 100 of this embodiment, the intermediate roller pair 4 is not stopped, and the waiting time period W1, in which the registration roller pair 5 is stopped from the time when the sheet arrival is detected by the upstream sensor S1, is kept constant so that the bending amount of the sheet P is kept constant. Therefore, as long as the sheet size is the same, the result of the measurement of the time period from the sheet arrival detection of the upstream sensor S1 to the sheet passage detection of the downstream sensor S2 (first measurement time period L1) is substantially the same in every case. Therefore, for example, the sheet size detection data may be provided in the format of a table that defines the sheet sizes relative to the first measurement time period L1, in consideration of the result of the measurement of the first measurement time period L1 for each sheet size, which is obtained through experiments, the sheet transportation speed, and the waiting time period W1 of the registration roller pair 5 (see FIG. 7). For example, the memory 92 of the engine control unit 9 stores the table. The engine control unit 9 may avoid performing computation and refer to the table, to thereby detect the standard sheet size in the sheet transportation direction based directly on the first measurement time period L1. In this manner, the engine control unit 9 can detect the size of the sheet P using the first measurement time period L1.

Subsequently, the engine control unit 9 confirms whether or not the transportation of all the sheets P is completed in the job (Step #8). When the transportation of all the sheets P is completed (Yes in Step #8), the engine control unit 9 stops the registration roller pair 5 and the intermediate roller pair 4 while performing the image formation, fixing, and delivery of the sheet P (Step #9), and the flow chart is finished (END).

On the other hand, when the transportation of all the sheets P is not completed (No in Step #8), the engine control unit 9 confirms whether or not the detected sheet size matches with the size of the sheet P that is set (input) for use by the user (Step #10). When the sheet size matches (Yes in Step #10), the engine control unit 9 stops (only) the registration roller pair 5 because the succeeding sheet P is fed from the sheet feeding unit 2 (Step #11), and the flow returns to Step #1.

On the other hand, when the sheet size does not match (No in Step #10), the printed sheet as desired by the user is not possibly obtained. Therefore, the engine control unit 9 first controls the image forming unit 6, the fixing unit 7*a*, and the delivery transportation unit 7*b* to deliver the sheet P sent out from the registration roller pair 5 (Step #12). Further, the engine control unit 9 causes the liquid crystal display unit 11 and the indicator 13 of the operation panel 1 to display and indicate an error indicating that the sheet size input and set for use in the printing is different from the detected sheet size (Step #13). Further, the engine control unit 9 stops the image forming operation (Step #14). For example, the engine control unit 9 also stops the sheet feeding from the sheet feeding unit 2, and holds the registration roller pair 5 and the intermediate roller pair 4 in the stopped state and holds the image forming unit 6 in a state in which the image formation is not performed. Then, the flow chart is temporarily finished (END).

Note that, when the printer 100 is stopped due to the difference between the set sheet size and the detected sheet size, the engine control unit 9 may resume the printing under a condition in which the operation panel 1 receives an input for instructing the continuance of the printing (in this case, for example, the flow starts from Step #1 again). Note that, the contents input through the operation panel 1 are, for example, transmitted to the engine control unit 9 via the control unit 8.

(Correction of Timing To Start Rotation of Registration Roller Pair 5)

Next, referring to FIG. 8, description is given of an example of correction of the timing to start rotation of the registration roller pair 5, which is to be performed in the printer 100 according to the first embodiment. FIG. 8 is a table showing an example of measurement result data on a time period from the sheet arrival detection of the upstream sensor S1 to the sheet arrival detection of the downstream sensor S2 (correction measurement time period L0: see FIG. 4) according to the first embodiment.

In the printer 100 of this embodiment, the registration roller pair 5 is rotated and stopped during the printing. The engine control unit 9 supplies a signal for turning ON and OFF (coupling and releasing) the registration roller electromagnetic clutch 51 to control the rotation and stop of the registration roller pair 5.

The registration roller electromagnetic clutch 51 also has an individual difference, and hence the response speed fluctuates to some degree in each clutch for the registration roller. Further, due to the deterioration over time through the use, the response speed of the registration roller electromagnetic clutch 51 may decrease and fluctuate. When the response speed of the registration roller pair 5 fluctuates, the bending amount of the sheet P and the position of transfer of the toner image fluctuate. For example, when the response speed of the registration roller electromagnetic clutch 51 decreases, the bending amount of the sheet P tends to increase.

Therefore, in the printer 100 of this embodiment, the engine control unit 9 corrects a timing to issue a signal for rotating the registration roller pair 5 (ON signal for the registration roller electromagnetic clutch 51). This point is described with reference to FIG. 8.

In this case, the waiting time period W1 of the registration roller pair 5 from the sheet arrival detection of the upstream sensor S1 is constant. Therefore, for example, an ideal time period from the sheet arrival detection of the upstream sensor S1 to the sheet arrival detection of the downstream sensor S2 (reference measurement time period) may be set as a time period determined by dividing the distance from the upstream sensor S1 to the downstream sensor S2 by the sheet transportation speed and adding the waiting time period W1 to the value (time period) thus determined (an ideal response time period of the registration roller electromagnetic clutch 51 from the time when the signal for instructing the registration roller pair 5 to start rotation is supplied to the time when the registration roller pair 5 actually starts rotation may be added). Note that, the reference measurement time period may be determined based on actual measurement results obtained through experiments or the like, in which the sheet P is transported a plurality of times.

However, in the actual sheet transportation, the time period from the sheet arrival detection of the upstream sensor S1 to the sheet arrival detection of the downstream sensor S2 (correction measurement time period L0) deviates from the predetermined ideal time period (reference measurement time period). This deviation is partly caused by the individual difference of the registration roller electromagnetic clutch 51 and the deterioration of the registration roller electromagnetic clutch 51 over time. Therefore, as illustrated in FIG. 8, for example, the engine control unit 9 stores, in the memory 92 as the measurement result data for each sheet P, the deviation between the correction measurement time period LO and the ideal time period.

FIG. 8 shows an example of the measurement result data obtained by accumulating the deviations between results of the measurement of the correction measurement time period L0 for 500 sheets and the ideal time period (reference measurement time period), and to be used for correcting the timing to rotate the registration roller pair 5 every time 500 sheets are printed (in a cycle of 500 sheets). Note that, the number of sheets as a cycle of the timing correction may be determined arbitrarily. More than 500 sheets (for example, 1,000 sheets) may be set as the cycle of the timing correction. Further, less than 500 sheets may be set as the cycle of the timing correction, and for example, the timing correction may be performed every time one sheet is transported.

Further, in the printer 100 of this embodiment, the timing to rotate the registration roller pair 5 is corrected based on an average value among the deviations between the correction measurement time period L0 for the respective sheets P and the reference measurement time period. When the deviation is determined by subtracting the reference measurement time period from the correction measurement time period L0 and when the average value is a positive value, the response speed of the registration roller pair 5 tends to decrease (tends to increase when the average value is a negative value). When 500 sheets are printed, for example, the engine control unit 9 determines the average value by dividing the total sum of the deviations for 500 sheets by 500. Then, the engine control unit 9 corrects the timing to rotate the registration roller pair 5 (timing to supply the ON signal to the registration roller electromagnetic clutch 51) so as to eliminate the deviations.

For example, when the determined average value indicates the delayed time period with respect to the ideal time period, the engine control unit 9 advances the timing to supply the ON signal to the registration roller electromagnetic clutch 51. Further, when the determined average value indicates the advanced time period with respect to the ideal time period, the engine control unit 9 delays the timing to supply the ON signal to the registration roller electromagnetic clutch 51. Accordingly, the actual waiting time period W1 from the sheet arrival detection of the upstream sensor S1 to the rotation of the registration roller pair 5 is corrected, with the result that the bending amount of the sheet P is kept constant.

As described above, the image forming apparatus (for example, the printer 100) according to the present disclosure includes the image forming unit 6 for forming an image on the sheet P, the sheet feeding unit 2 for feeding the sheet P, at least one detection member (upstream sensor S1 and downstream sensor S2) provided on the upstream side of the image forming unit 6 in the sheet transportation direction, the registration roller (registration roller pair 5) for transporting the sheet P fed from the sheet feeding unit 2 toward the image forming unit 6, the registration roller being configured to be held in the stopped state when the at least one detection member provided on the upstream side in the sheet transportation direction detects the sheet arrival, and to rotate when the predetermined waiting time period has elapsed since the at least one detection member provided on the upstream side detects the sheet arrival, the rotational member (intermediate roller pair 4) for transporting the sheet P fed from the sheet feeding unit 2 toward the registration roller, the rotational member being configured to continue rotation until the transportation of all the sheets P to be used for printing is completed, and the sheet size detection unit (engine control unit 9) for detecting the size of the sheet in response to an output from the at least one detection member using the time period from the time when the at least one detection member detects the sheet arrival to the time when the at least one detection member detects the sheet passage.

First, when the sheet P is brought into abutment against the registration roller (registration roller pair 5) to bend the sheet P, the rotational member (intermediate roller pair 4) situated on the upstream side of the registration roller is not stopped. Accordingly, the bending amount of the sheet P can be kept substantially constant in every case irrespective of the individual difference in response speed of the drive of the rotational member and the decrease in response speed due to the deterioration over time. In other words, any sheet P is detected by the upstream detection member (upstream sensor S1), and the rotational member transports the sheet P by the same amount in every case after the sheet P is brought into abutment against the registration roller. Then, the registration roller starts rotation (starts transportation). Therefore, the bending amount of the sheet P is substantially constant in every case, and the state of the sheet P at the time when the registration roller starts rotation (starts transportation) is substantially constant in every case. Accordingly, as long as the sheet size is the same, the time period from the time when the at least one detection member (upstream sensor S1 and downstream sensor S2) detects the sheet arrival to the time when the at least one detection member detects the sheet passage is substantially the same in every case. Thus, an error in time period measured for the sheet size detection can be reduced as compared to the conventional case, with the result that the sheet size can be detected accurately.

Further, the at least one detection member includes the upstream detection member (upstream sensor S1) provided on the upstream side of the registration roller (registration roller pair 5) in the sheet transportation direction, and the downstream detection member (downstream sensor S2) provided on the downstream side of the registration roller in the sheet transportation direction. The sheet size detection unit (engine control unit 9) detects the size of the sheet using the first measurement time period L1 from the sheet arrival detection of the upstream detection member to the sheet passage detection of the downstream detection member. The bending amount of the sheet P is constant and the state of the sheet P at the time when the sheet P is transported toward the image forming unit 6 is substantially constant. Accordingly, as long as the sheet size is the same, the time period from the sheet arrival detection of the upstream detection member to the sheet passage detection of the downstream detection member (first measurement time period L1) is substantially the same in every case. Thus, the error in time period measured for the sheet size detection can be reduced as compared to the conventional case, with the result that the sheet size can be detected accurately.

Further, also in the registration roller (registration roller pair 5), there may be an individual difference in response speed of ON/OFF of the drive, and decrease in response speed due to the deterioration over time. For example, when the response speed decreases due to the deterioration over time and therefore the sending is delayed, the bending amount of the sheet P tends to increase. Such fluctuation in response speed of the registration roller may cause fluctuation in bending amount of the sheet. Therefore, the image forming apparatus includes the drive control unit (engine control unit 9) for controlling the drive of the registration roller by issuing a signal for instructing the rotation and stop of the registration roller. The drive control unit changes the timing to issue the signal for instructing the start of rotation so as to eliminate the difference between the predetermined reference measurement time period and the correction measurement time period L0 from the sheet arrival detection of the upstream detection member (upstream sensor S1) to the sheet arrival detection of the downstream detection member (upstream sensor S1 and downstream sensor S2). Accordingly, as long as the sheet size is the same, the bending amount of the sheet is substantially constant at any time, and as a result, as long as the sheet size is the same, the correction measurement time period L0 is substantially constant at any time. In other words, even when the individual difference in response speed and the deterioration over time are present in the registration roller, the actual waiting time period W1 of the registration roller is approximated to the ideal waiting time period W1. Thus, the fluctuation in bending amount of the sheet P that is caused by the individual difference of the registration roller and the deterioration of the registration roller over time can be reduced, with the result that the sheet size can be detected accurately. Note that, the predetermined reference measurement time period is the ideal correction measurement time period L0 determined based on the ideal waiting time period W1 of the registration roller, the sheet transportation speed, and the distance between the upstream detection member and the downstream detection member.

Further, the image forming apparatus (printer 100) includes the memory 92 for storing, for each sheet, at least one of the correction measurement time period L0 and the difference between the correction measurement time period L0 and the predetermined reference measurement time period. The drive control unit (engine control unit 9) changes the timing to issue the signal for instructing the start of rotation by an amount corresponding to an average value among differences between the correction measurement time period L0 and the predetermined reference measurement time period for a predetermined plurality of sheets. With this configuration, though the difference between the correction measurement time period L0 and the predetermined reference measurement time period may vary depending on each sheet P, the timing to start rotation of the registration roller (registration roller pair 5) can be corrected so that the error is corrected on average.

Further, the downstream detection member (downstream sensor S2) is provided between the image forming unit 6 and the registration roller (registration roller pair 5). The image forming unit 6 starts the image formation when the downstream detection member recognizes the sheet arrival. Accordingly, the image formation (formation and transfer of the toner image) is started with such a trigger that the downstream detection member detects the sheet having already sent out from the registration roller. Thus, even when fluctuation in response speed is present in ON/OFF of the registration roller (coupling and releasing of the registration roller electromagnetic clutch 51), the toner image can be transferred to the sheet without any deviation from the targeted position of the sheet.

Further, the image forming apparatus (printer 100) includes the input unit (operation panel 1 and I/F unit 84) for inputting the size of the sheet to be used for printing, and the notification unit (liquid crystal display unit 11 and indicator 13) for notifying, when the size of the sheet input for use in the printing is different from the size of the sheet detected by the sheet size detection unit (engine control unit 9), that the size of the sheet input for use in the printing is different from the size of the sheet P actually used for the printing. Accordingly, the user can recognize that the printing is performed on the sheet P having a size different from the desired size. In addition, the notification is performed based on the accurately detected sheet size, and hence erroneous notification does not occur.

Further, the image forming apparatus (printer 100) includes the delivery unit (delivery transportation unit 7*b*) for delivering the printed sheet P toward outside of the image forming apparatus. When the size of the sheet input for use in the printing is different from the size of the sheet detected by the sheet size detection unit (engine control unit 9), the delivery unit delivers the printed sheet P, the registration roller (registration roller pair 5) and the rotational member (intermediate roller pair 4) stop rotation thereof, and the image forming unit 6 stops image formation on the sheet P succeeding the printed sheet P. Accordingly, even when the sheet size is different, there is no determination that the jam has occurred, and the printed sheet P is delivered. Thus, there is no need for the user to perform jam processing of removing the sheet P having the different size from inside of the image forming apparatus. Further, it is possible to suppress damage to the members inside the image forming apparatus, such as the image forming unit 6, which may be caused by actions such as forced pull of the sheet P out of the image forming apparatus at the time of the jam processing. Further, it is possible to stop the printing on the sheet P having the incorrect size.

Note that, the present disclosure may be interpreted as a sheet size detection method. Specifically, the sheet size detection method according to the embodiment of the present disclosure includes feeding the sheet P from the sheet feeding unit 2, forming an image on the sheet P by the image forming unit 6, transporting the sheet P fed from the sheet feeding unit 2 toward the image forming unit 6 by the registration roller, which is configured to be held in the stopped state when the at least one detection member (upstream sensor S1 and downstream sensor S2) provided on the upstream side of the image forming unit 6 in the sheet transportation direction detects the sheet arrival, and to rotate when the predetermined waiting time period has elapsed since the at least one detection member detects the sheet arrival, transporting the sheet P fed from the sheet feeding unit toward the registration roller by the rotational member (intermediate roller pair 4), which is configured to continue rotation until the transportation of all the sheets P to be used for printing is completed, and detecting the size of the sheet in response to the output from the at least one detection member using the time period from the time when the at least one detection member detects the sheet arrival to the time when the at least one detection member detects the sheet passage.

(Second Embodiment)

Figure 9:
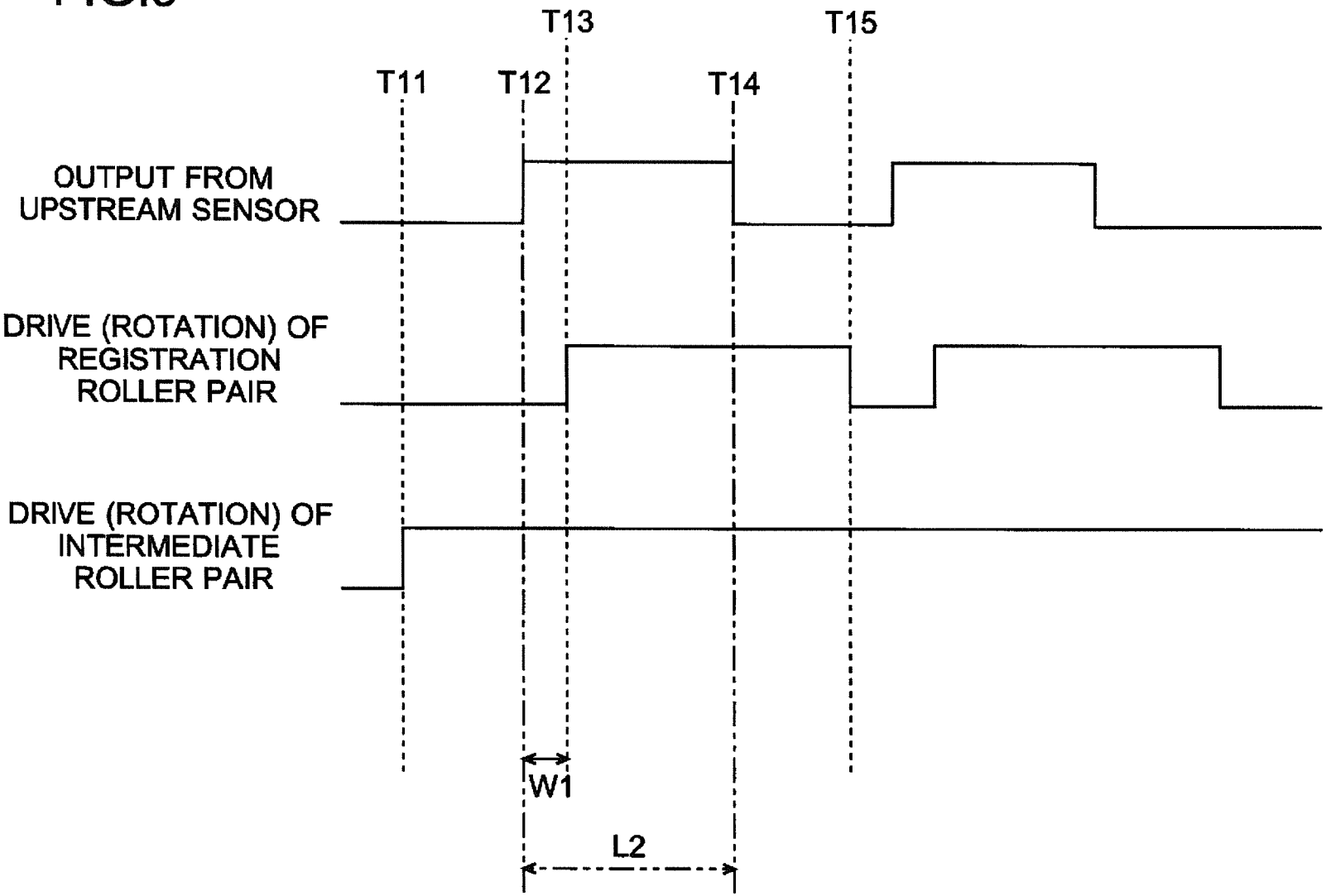
FIG. 9 is a timing chart illustrating sheet size detection to be performed in a printer according to a second embodiment of the present disclosure.
Figure 10:
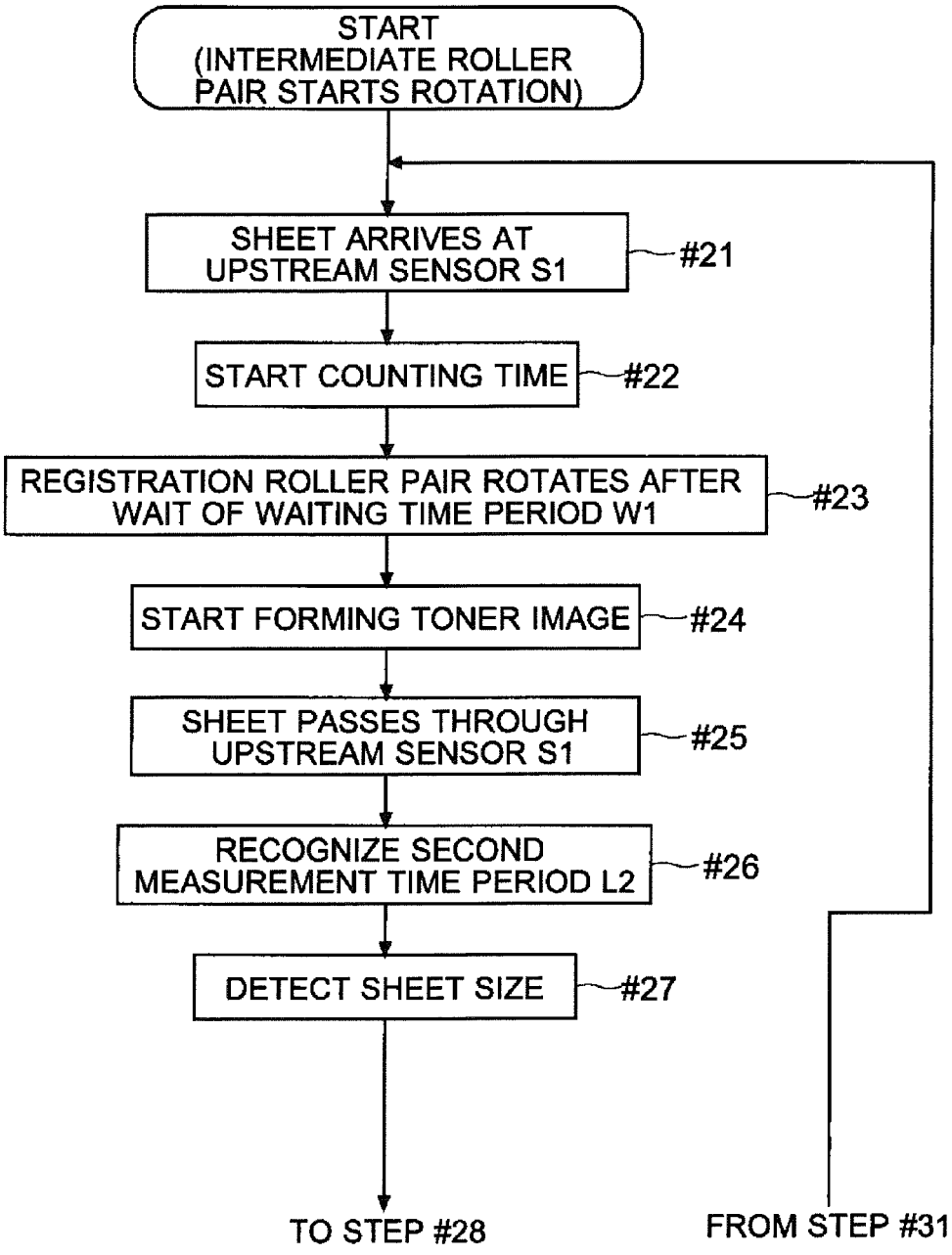
FIG. 10 is a flow chart illustrating an example of a flow of the sheet size detection to be performed in the printer using an upstream sensor according to the second embodiment.
Figure 11:
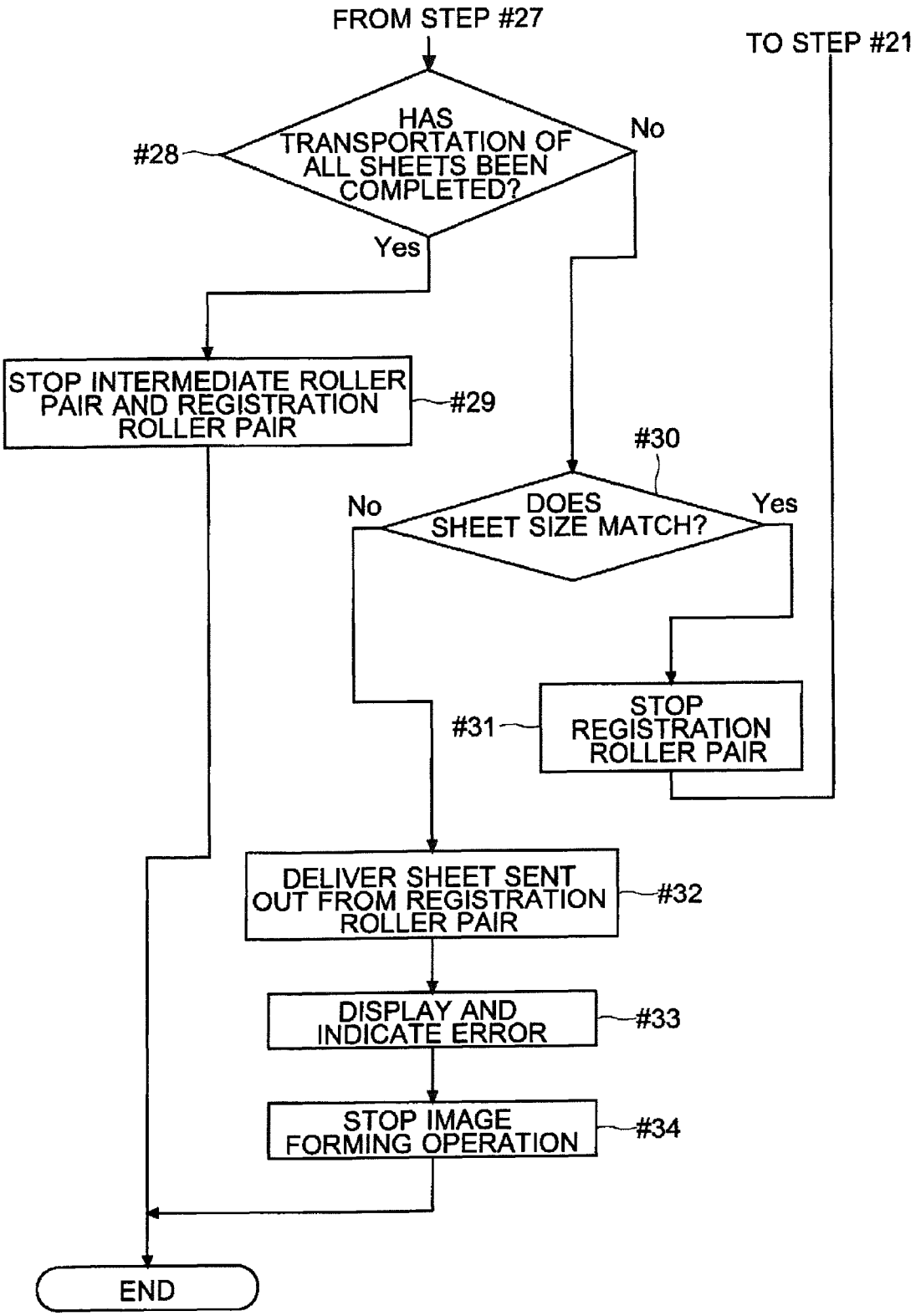
FIG. 11 is a flow chart illustrating the example of the flow of the sheet size detection to be performed in the printer using the upstream sensor according to the second embodiment.

Next, referring to FIGS. 9 to 11, description is given of sheet size detection to be performed in an image forming apparatus (printer 100) according to a second embodiment of the present disclosure. FIG. 9 is a timing chart illustrating the sheet size detection to be performed in the printer 100 according to the second embodiment. FIGS. 10 and 11 are flow charts illustrating an example of a flow of the sheet size detection to be performed in the printer 100 using an upstream sensor S1 according to the second embodiment. Note that, the flow is long, and hence a sequential flow chart is divided into two in FIGS. 10 and 11.

In the first embodiment, the description has been given of the example of the sheet size detection using the upstream sensor S1 and the downstream sensor S2 (using the first measurement time period L1). The second embodiment is different from the first embodiment in that the sheet size detection is performed using only the upstream sensor S1. However, the structure and configuration of the printer 100 itself may be similar to those of the first embodiment. Therefore, the description of the first embodiment may be employed for the matters common between the first embodiment and the second embodiment, and hence description and illustration of the common matters are omitted except the case where description is particularly needed.

First, a chart on the topmost stage in FIG. 9 illustrates changes in output from the upstream sensor S1. Note that, also in this embodiment, the upstream sensor S1 outputs a High when the presence of the sheet P is detected, and outputs a Low when the presence of the sheet P is not detected.

Further, a chart on the middle stage in FIG. 9 illustrates a signal from the engine control unit 9 for instructing the registration roller electromagnetic clutch 51 to start rotation of the registration roller pair 5, in which a High indicates a rotating state of the registration roller pair 5 and a Low indicates a stopped state of the registration roller pair 5. Further, a chart on the bottommost stage in FIG. 9 illustrates ON/OFF of the drive of the intermediate roller pair 4, in which a High indicates a rotating state of the intermediate roller pair 4 and a Low indicates a stopped state of the intermediate roller pair 4.

Next, the timing chart is described along with the elapse of time. First, the engine control unit 9 rotates the intermediate roller pair 4 so as to transport the sheet P (time point T11 in FIG. 9). The sheet P is transported by the intermediate roller pair 4, and as a result, the sheet P arrives at the upstream sensor S1. The engine control unit 9 recognizes a change in output from the upstream sensor S1, and recognizes the sheet arrival at the upstream sensor S1 (time point T12 in FIG. 9).

Then, the engine control unit 9 holds the registration roller pair 5 in the stopped state until the predetermined waiting time period W1 (period between T12 and T13 in FIG. 9) elapses since the sheet arrival at the upstream sensor S1. Accordingly, the sheet P is bent to the same degree at any time. When the waiting time period W1 has elapsed since the sheet arrival at the upstream sensor S1, the engine control unit 9 rotates the registration roller pair 5 (time point T13 in FIG. 9). After that, through the sheet transportation by the registration roller pair 5, the trailing edge of the sheet P passes through the upstream sensor S1, with the result that the output from the upstream sensor S1 falls. Accordingly, the engine control unit 9 recognizes that the sheet P has passed through the upstream sensor S1 (time point T14 in FIG. 9). Then, the engine control unit 9 stops the registration roller pair 5 by the time when the upstream sensor S1 detects the arrival of the succeeding sheet P (time point T15 in FIG. 9).

In this embodiment, based on a time period from the sheet arrival detection of the upstream sensor S1 to the sheet passage detection of the upstream sensor S1 (second measurement time period L2, which is a time period from T12 to T14 in FIG. 9), the size of the sheet P in the sheet transportation direction is detected. Note that, also in the printer 100 of this embodiment, the intermediate roller pair 4 rotates and also the waiting time period W1 of the registration roller pair 5 is kept constant. Therefore, the bending amount of the sheet P (degree of bending) is substantially the same at any time. Therefore, the state of the sheet P to be sent out from the registration roller pair 5 is substantially the same among the sheets P. Thus, as long as the sheet P is the same, the time period from the sheet arrival detection of the upstream sensor S1 to the sheet passage detection of the upstream sensor S1 (second measurement time period L2) is substantially the same at any time.

Therefore, in this embodiment, the engine control unit 9 detects the sheet size based on the time period from the sheet arrival detection of the upstream sensor S1 to the sheet passage detection of the upstream sensor S1 (second measurement time period L2). There are conceived various methods for determining the sheet size based on the second measurement time period L2. For example, the second measurement time period L2 includes the waiting time period W1 of the registration roller pair 5 for bending the sheet. In other words, when the waiting time period W1 is subtracted from the second measurement time period L2, a substantial time period required from the arrival of the sheet P at the upstream sensor S1 to the passage of the sheet P through the upstream sensor S1 is determined. Further, as described above, the sheet transportation speed is predetermined in terms of the specification and design of the printer 100. Therefore, for example, the engine control unit 9 subtracts the waiting time period W1 from the second measurement time period L2, and determines the size (length) of the sheet P in the transportation direction through multiplication by the predetermined sheet transportation speed. In this manner, the engine control unit 9 can detect the sheet size through computation. For example, in the memory 92 of the engine control unit 9, data indicating the sheet transportation speed and data indicating the waiting time period W1 of the registration roller pair 5 may be stored as the sheet size detection data to be used for the computation (see FIG. 7).

Further, similarly to the first embodiment, the engine control unit 9 may compare the size of the sheet P determined through the computation to the standard sheet sizes of the sheet P, such as A-series sheets P and a letter size sheet, to thereby determine the corresponding standard size of the sheet P in use.

Further, in the printer 100 of this embodiment, the waiting time period W1 is kept constant so that the bending amount of the sheet P is kept constant. Therefore, as long as the sheet size is the same, the time period from the sheet arrival detection of the upstream sensor Si to the sheet passage detection of the upstream sensor S1 (second measurement time period L2) is substantially the same in every case. Therefore, for example, similarly to the first embodiment, there may be provided a table that defines the sheet sizes relative to the second measurement time period L2 (see FIG. 7). For example, the memory 92 of the engine control unit 9 stores the table. Accordingly, the engine control unit 9 may refer to the second measurement time period L2 and the table, to thereby detect the standard sheet size in the sheet transportation direction. In this manner, the engine control unit 9 can accurately detect the size of the sheet P using the second measurement time period L2 as well.

Note that, in this embodiment, the downstream sensor S2 is not necessarily provided in order to perform the sheet size detection. Therefore, in the printer 100 of this embodiment, the downstream sensor S2 may be omitted. Meanwhile, in order to correct the timing to start rotation of the registration roller pair 5, a sensor for detecting the arrival of the sheet P needs to be provided on the downstream side of the registration roller pair 5. Therefore, in order to correct the timing to start rotation of the registration roller pair 5 in the printer 100 of the second embodiment, the downstream sensor S2 may be provided in the printer 100 of the second embodiment.

Next, referring to FIGS. 10 and 11, description is given of the flow of the sheet size detection to be performed in the printer 100 according to this embodiment.

The flow chart of FIG. 10 starts at a time point when the I/F unit 84 receives the image data and the setting data for printing from the external computer 200 so that the printing is started, and therefore the sheet is fed and the engine control unit 9 causes the intermediate roller pair 4 to start rotation. Also in the second embodiment, at the time point of the start of the flow chart, the engine control unit 9 grasps the sheet size that is desired (designated) by the user for use in the printing.

When the printing is started and therefore the intermediate roller pair 4 starts rotation (START), the engine control unit 9 recognizes the sheet arrival at the upstream sensor S1 (Step #21). The engine control unit 9 starts counting time (Step #22). After the engine control unit 9 waits the predetermined waiting time period W1, the engine control unit 9 rotates the registration roller pair 5 (Step #23). Subsequently, the engine control unit 9 starts forming the toner image (Step #24).

Subsequently, the engine control unit 9 detects that the sheet P has passed through the upstream sensor S1 (Step #25). Along with the detection, the engine control unit 9 recognizes the time period from the sheet arrival detection of the upstream sensor S1 to the sheet passage detection of the upstream sensor S1 (second measurement time period L2) (Step #26). Then, the engine control unit 9 detects the sheet size based on the second measurement time period L2 and the sheet size detection data (Step #27).

Note that, Step #28 and subsequent steps (Steps #28 to #34) may be similar to Steps #8 to #14 described in the first embodiment, and hence the description is omitted herein.

As described above, in the image forming apparatus (printer 100) according to the second embodiment of the present disclosure, the at least one detection member is the upstream detection member (upstream sensor S1) provided on the upstream side of the registration roller (registration roller pair 5) in the sheet transportation direction. The sheet size detection unit (engine control unit 9) detects the size of the sheet using the second measurement time period L2 from the time when the upstream detection member detects the sheet arrival to the time when the upstream detection member detects the sheet passage. The bending amount of the sheet P is constant and the state of the sheet P at the time when the sheet P is transported toward the image forming unit 6 is substantially constant. Accordingly, as long as the sheet size is the same, the time period from the sheet arrival detection of the upstream detection member to the sheet passage detection of the upstream detection member is substantially the same in every case. Thus, the error in time period measured for the sheet size detection can be reduced as compared to the conventional case, with the result that the sheet size can be detected accurately.

Next, other embodiments of the present disclosure are described. The above-mentioned embodiments have been described on the example in which the engine control unit 9 serves as the sheet size detection unit for detecting the sheet size, and also as the drive control unit for controlling the drive (rotation/stop) of the registration roller pair 5 by issuing a signal to the registration roller electromagnetic clutch 51. Alternatively, the engine control unit 9 may function as the sheet size detection unit and the drive control unit may be provided separately. Still alternatively, the engine control unit 9 may function as the drive control unit and the sheet size detection unit may be provided separately.

The embodiments of the present disclosure have been described above, but the scope of the present disclosure is not limited thereto, and various modifications may be made thereto without departing from the gist of the present disclosure.

What is claimed is:

1. An image forming apparatus, comprising:

an image forming unit for forming an image on a sheet;

a sheet feeding unit for feeding the sheet;

at least one detection member provided on an upstream side of the image forming unit in a sheet transportation direction;

a registration roller for transporting the sheet fed from the sheet feeding unit toward the image forming unit, the registration roller being configured to be held in a stopped state when the at least one detection member provided on the upstream side in the sheet transportation direction detects sheet arrival, and to rotate when a predetermined waiting time period has elapsed since the at least one detection member provided on the upstream side detects the sheet arrival;

a rotational member for transporting the sheet fed from the sheet feeding unit toward the registration roller, the rotational member being configured to continue rotation until transportation of all the sheets to be used for printing is completed; and a sheet size detection unit for detecting a size of the sheet in response to an output from the at least one detection member using a time period from a time when the at least one detection member detects the sheet arrival to a time when the at least one detection member detects sheet passage;

wherein the at least one detection member comprises:

an upstream detection member provided on an upstream side of the registration roller in the sheet transportation direction; and a downstream detection member provided on a downstream side of the registration roller in the sheet transportation direction, and wherein the sheet size detection unit detects the size of the sheet using a first measurement time period from sheet arrival detection of the upstream detection member to sheet passage detection of the downstream detection member.

2. An image forming apparatus according to claim 1, further comprising a drive control unit for controlling drive of the registration roller by issuing a signal for instructing rotation and stop of the registration roller, wherein the drive control unit changes a timing to issue a signal for instructing start of rotation so as to eliminate a difference between a predetermined reference measurement time period and a correction measurement time period from the sheet arrival detection of the upstream detection member to the sheet arrival detection of the downstream detection member.

3. An image forming apparatus according to claim 2, further comprising a memory for storing, for each sheet, at least one of the correction measurement time period and the difference between the correction measurement time period and the predetermined reference measurement time period, wherein the drive control unit changes the timing to issue the signal for instructing the start of rotation by an amount corresponding to an average value among differences between the correction measurement time period and the predetermined reference measurement time period for a predetermined plurality of sheets.

4. An image forming apparatus according to claim 1, wherein the downstream detection member is provided between the image forming unit and the registration roller, and wherein the image forming unit starts image formation when the downstream detection member recognizes the sheet arrival.

5. An image forming apparatus according to claim 1, further comprising:

an input unit for inputting a size of the sheet to be used for the printing; and a notification unit for notifying, when the size of the sheet input for use in the printing is different from the size of the sheet detected by the sheet size detection unit, that the size of the sheet input for use in the printing is different from the size of the sheet actually used for the printing.

6. An image forming apparatus according to claim 5, further comprising a delivery unit for delivering a printed sheet toward outside of the image forming apparatus, wherein, when the size of the sheet input for use in the printing is different from the size of the sheet detected by the sheet size detection unit, the delivery unit delivers the printed sheet, the registration roller and the rotational member stop rotation thereof, and the image forming unit stops image formation on a sheet succeeding the printed sheet.

7. A sheet size detection method, comprising:

feeding a sheet from a sheet feeding unit;

forming an image on the sheet by an image forming unit;

transporting the sheet fed from the sheet feeding unit toward the image forming unit by a registration roller, which is configured to be held in a stopped state when at least one detection member provided on an upstream side of the image forming unit in a sheet transportation direction detects sheet arrival, and to rotate when a predetermined waiting time period has elapsed since the at least one detection member detects the sheet arrival;

transporting the sheet fed from the sheet feeding unit toward the registration roller by a rotational member, which is configured to continue rotation until transportation of all the sheets to be used for printing is completed; and detecting a size of the sheet in response to an output from the at least one detection member using a time period from a time when the at least one detection member detects the sheet arrival to a time when the at least one detection member detects sheet passage;

wherein the detecting comprises detecting the size of the sheet using a first measurement time period from sheet arrival detection of an upstream detection member, which is provided on an upstream side of the registration roller in the sheet transportation direction, to sheet passage detection of a downstream detection member, which is provided on a downstream side of the registration roller in the sheet transportation direction.

8. A sheet size detection method according to claim 7, further comprising:

controlling drive of the registration roller by issuing a signal for instructing rotation and stop of the registration roller; and changing a timing to issue a signal for instructing start of rotation so as to eliminate a difference between a predetermined reference measurement time period and a correction measurement time period from the sheet arrival detection of the upstream detection member to the sheet arrival detection of the downstream detection member.

9. A sheet size detection method according to claim 8, further comprising:

storing, in a memory, for each sheet, at least one of the correction measurement time period and the difference between the correction measurement time period and the predetermined reference measurement time period; and changing the timing to issue the signal for instructing the start of rotation by an amount corresponding to an average value among differences between the correction measurement time period and the predetermined reference measurement time period for a predetermined plurality of sheets.

10. A sheet size detection method according to claim 7, further comprising starting, by the image forming unit, image formation when the downstream detection member, which is provided between the image forming unit and the registration roller, recognizes the sheet arrival.

11. A sheet size detection method according to claim 7, further comprising:

receiving an input of a size of the sheet to be used for the printing; and notifying, when the size of the sheet input for use in the printing is different from the size of the sheet detected, that the size of the sheet input for use in the printing is different from the size of the sheet actually used for the printing.

12. A sheet size detection method according to claim 11, further comprising:

when the size of the sheet input for use in the printing is different from the size of the sheet detected, delivering a printed sheet toward outside of an image forming apparatus;

stopping rotation of the registration roller and the rotational member; and stopping image formation to be performed on a sheet succeeding the printed sheet by the image forming unit.

* * * * *